United States Patent [19]

Linstromberg et al.

[11] 4,176,527

[45] Dec. 4, 1979

[54] ICE CRUSHER FOR REFRIGERATOR

[75] Inventors: William J. Linstromberg; Robert F. Hartman, both of Evansville, Ind.

[73] Assignee: Whirlpool Corporation, Benton Harbor, Mich.

[21] Appl. No.: 924,378

[22] Filed: Jul. 13, 1978

[51] Int. Cl.[2] ..... F25C 5/02

[52] U.S. Cl. ..... 62/320; 222/240; 241/190; 241/DIG. 17

[58] Field of Search ..... 62/320; 241/190, DIG. 17, 241/243; 222/236, 239, 240

[56] References Cited

U.S. PATENT DOCUMENTS

| | | | |
|---|---|---|---|
| 591,988 | 10/1897 | Munson | 241/251 |
| 985,211 | 2/1911 | Selden | 110/106 |
| 2,645,910 | 7/1953 | Leeson | 62/320 |
| 2,839,254 | 6/1958 | Smith | 241/154 |
| 2,904,268 | 9/1959 | Chappell et al. | 241/190 |
| 3,602,441 | 8/1971 | Alvarez | 241/101 |
| 3,843,067 | 10/1974 | Prada | 241/190 |
| 3,889,888 | 6/1975 | Prada | 241/101.1 |

*Primary Examiner*—William F. O'Dea
*Assistant Examiner*—William E. Tapolcai
*Attorney, Agent, or Firm*—Wegner, Stellman, McCord, Wiles & Wood

[57] ABSTRACT

Apparatus for delivering ice from an ice body maker to an ice delivery area selectively in the form of ice bodies or as crushed ice. The ice crusher is mounted in a housing and includes first and second crusher arms mounted to a rotatable shaft therein. A stop is provided for preventing rotation of the second crusher arm while permitting the first crusher arm to continue rotation with the shaft. The relative movement between the crusher arms effects a crushing of the ice bodies so as to permit the ice to then be delivered to the delivery area in the form of crushed ice. When the stop is positioned so as to permit rotation of both the first and second crusher arms with the shaft, the ice bodies are delivered intact thereby to the delivery area. The stop is arranged to prevent rotation of the second crusher arm in either direction when disposed to prevent movement of the second crusher arm with the shaft. The stop may be pivotally mounted to the housing and the control for selectively positioning the stop may be provided within the housing. The stop may be disposed adjacent the outlet portion of the housing to provide guiding of the ice from the crusher arms to the outlet portion.

19 Claims, 8 Drawing Figures

10
11
12
13
14
15
16
17
18
19
20
21
22
23
24
25
26
27
30
31
32
35

5

24
22
31
58
29
37
40
43
38
36
54
50
23
30
39
52
42
41
21
25
47
48
27

5

25
30
31
26
32
33
34
21
56
36
41
47
23

ICE CRUSHER FOR REFRIGERATOR

BACKGROUND OF THE INVENTION

1. Field of the Invention

This invention relates to ice makers and in particular to means for conducting ice from an ice maker to a delivery position.

2. Description of the Prior Art

A recent substantial improvement in the utilization of refrigerators and freezers has been the provision of automatic ice makers which may be connected to a suitable water supply external to the refrigeration apparatus and which automatically provide supplies of ice bodies to a storage bin in association therewith for convenient utilization by the user of the apparatus.

It has recently been found desirable to provide a further improvement in such ice makers by utilizing in conjunction therewith means for effecting delivery of the ice from the ice maker not only in the ice body, or cube, form, but also in the form of crushed ice, thus eliminating the need for the user to effect a separate ice crushing operation after removing the ice bodies from the apparatus.

Another improvement in the basic ice body maker concept recently developed is the provision of means for automatically transferring ice bodies from the collecting bin to a dispensing or delivery position. Conveying means, conventionally in the form of augers, have been used to effect such automatic delivery.

Thus, it has been found desirable to utilize in conjunction with domestic refrigerators and the like means for automatically providing ice bodies, means for transferring the ice bodies made by the automatic ice maker from a collecting bin portion thereof to a dispensing or delivery space, and means for selectively providing the ice bodies in the form of crushed ice.

Referring now to the prior art patents, Countcil Munson shows, in U.S. Pat. No. 591,988, a grinding mill utilizing a pair of oppositely rotating members which are coaxially disposed and driven by their own respective shaft and drive means. A coupling is provided to maintain axial alignment in the grinding operation.

Arthur R. Selden discloses, in U.S. Pat. No. 985,211, an automatic fuel feeding device wherein a conveyor is provided for delivering lumps of coal and the like to a crushing area wherein the lumps are crushed by cooperating crushing wheels having spaced, parallel axes.

In U.S. Pat. No. 2,645,910, Meldon Gerald Leeson shows an ice making apparatus having a delivery chute provided with a movable guide so that the ice bodies can be directed from the ice maker selectively to a grinding means or in a bypass passage about the grinding means for selectively providing the ice bodies in crushed ice or intact ice body form.

In the icing machine disclosed by Frederick L. Smith in U.S. Pat. No. 2,839,254, means are provided for reducing cakes of ice to smaller sizes for facilitating their use in railway cars and the like. The ice cakes are crushed between a set of rotating picks and a rotatable star wheel, and further crushing is effected between the rotating picks and a set of cooperating blades. Both the star wheel and the blades are movable to adjust the degree of crushing provided.

A combination ice cube and crushed ice dispenser is shown in U.S. Pat. No. 3,602,441 of Robert J. Alvarez. The ice dispenser thereof utilizes means for selectively dispensing the ice cubes from a storage receptacle intact or crushing them for dispensing crushed ice as desired. The ice bodies are delivered through an inlet opening to a transfer space having an outlet opening generally below the inlet opening. Rotatable crusher arms are disposed so as to swing through the path of movement of the ice bodies from the inlet to the outlet. Normally, the crusher arms do not prevent the transfer of the ice bodies substantially intact to the outlet. However, Alvarez teaches that a deflector may be provided for directing the ice bodies from the straight-through path to the outlet and guiding them to fixed crusher means associated with the arms so as to permit the rotating arms to effect a crushing of the ice bodies for subsequent delivery to the outlet. Alvarez teaches a number of different forms of deflector means for effecting such selective ice body and crushed ice delivery.

Luis E. Prada, in U.S. Pat. No. 3,889,888, shows a combination ice cube and crushed ice dispenser which is generally similar to that of the Alvarez structure except that a movable anvil is provided in the crushing means for selectively providing fine crushed or coarse crushed ice, as desired. As in Alvarez, a deflector is provided to permit selective delivery of ice bodies or either form of the crushed ice.

SUMMARY OF THE INVENTION

The present invention comprehends an improved apparatus for delivering ice from an ice body supply to an ice delivery area selectively in ice body form or as crushed ice.

More specifically, the invention comprehends providing such apparatus including housing means defining an inlet portion for receiving ice bodies from the supply and an outlet portion communicating with the delivery position, a rotatable shaft disposed within the housing, first crusher arm means fixed to the shaft for rotation coaxially therewith, second crusher arm means coupled to the shaft for releasable rotation coaxially therewith, and selector means movably carried in the housing and selectively positionable in a first position allowing rotation of the second crusher arm means with the shaft thereby permitting the first and second crusher arm means to deliver the ice bodies substantially intact to the outlet portion, and in a second position for preventing the rotation of the second crusher arm means to cause the ice bodies to be crushed between the first and second crusher arm means as a result of the rotation of the first crusher arm means with the shaft while the second crusher arm means is being maintained against rotation therewith for delivery of the ice to the outlet portion in the form of crushed ice.

The crusher arm means may comprise elongated, radially extending arms mounted to the rotatable shaft with a plurality of first crusher arms being interleaved between a plurality of second crusher arms.

The second crusher arms may be coupled to the shaft by a yieldable clutch which, in the illustrated embodiment, comprises a friction clutch.

The arms may comprise relatively thin blades with the first and second crusher arms being generally similar in configuration.

The selector means may comprise a stop movably carried by the housing and selectively positionable by suitable positioning means so as to dispose the stop in the path of movement of the second crusher arms.

The selector means may comprise means for holding the second crusher arms against rotation in either direction about the axis of the shaft, thereby providing an effectively fixed anvil against which the ice bodies are urged by the first crusher arms in forming the crushed ice in the apparatus.

Both the stop and the positioning means may be movably mounted to the housing and disposed internally thereof.

In the illustrated embodiment, the stop and positioning means are pivotally mounted to the housing.

The stop may include a guide portion disposed adjacent the outlet portion of the housing for guiding ice from the crusher arm means to the outlet portion in the operation of the device.

The crusher arm means are arranged to carry the ice bodies from the inlet portion to the outlet portion when arranged to provide the ice in ice body form at the delivery position. When arranged to provide the ice in crushed ice form, the first crusher arm means effects transfer of the ice bodies from the inlet portion to the fixed second crusher arm means, the crushed ice being then delivered directly to the outlet portion upon being crushed.

The ice delivering means of the present invention is extremely simple and economical of construction while yet providing the highly desirable features discussed above.

BRIEF DESCRIPTION OF THE DRAWING

Other features and advantages of the invention will be apparent from the following description taken in connection with the accompanying drawing wherein.

DESCRIPTION OF THE PREFERRED EMBODIMENT

Figures 1, 2, 3:
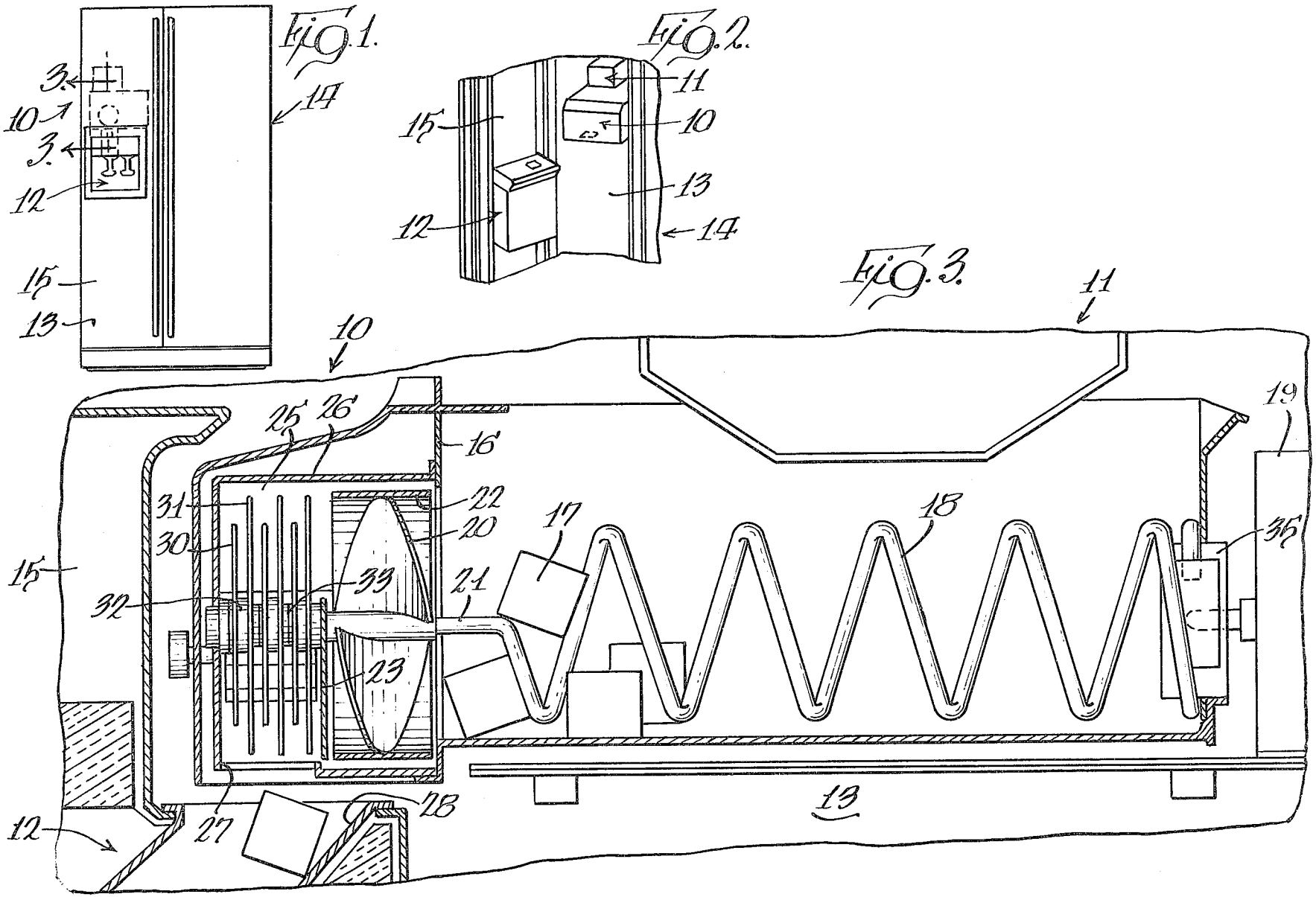
FIG. 1 is a front elevation of a refrigeration apparatus having an ice delivering means embodying the invention.
FIG. 2 is a perspective view of a portion of the refrigeration apparatus with the door thereof in an open position to illustrate more clearly the structure of the ice delivering means.
FIG. 3 is a fragmentary enlarged vertical section taken substantially along the line 3—3 of FIG. 1 and illustrating in greater detail the ice delivering means.

In the exemplary embodiment of the invention as disclosed in FIGS. 1-7 of the drawing, an apparatus generally designated 10 for delivering ice from an ice body supply generally designated 11 to an ice delivery area generally designated 12 is shown to be disposed illustratively in the freezer portion 13 of a freezer-refrigerator apparatus generally designated 14. Apparatus 14 is illustrated as a domestic freezer-refrigerator apparatus, it being understood that the invention is adapted for use with any suitable form of apparatus wherein it is intended to provide ice to a delivery or dispensing area from a suitable supply of ice bodies.

The present invention comprehends the provision of the ice by the delivering apparatus 10 selectively in the form of ice bodies or in the form of crushed ice, as desired.

In the illustrated embodiment, the delivery area 12 is defined by suitable wall means mounted in the door 15 of apparatus 14 selectively closing the freezer space. Thus, as shown in FIG. 2, when the door 15 is swung to the open position, the delivery area 12 of the apparatus is moved away from the ice delivering apparatus 10 to provide free access to the freezer space 13 subjacent the ice delivering apparatus 10 and ice body supply 11.

More specifically, as shown in FIG. 3, the ice body supply 11 includes wall means 16 defining a storage, or ice collecting, receptacle for storing the ice bodies 17 within the refrigerator space until needed. The ice bodies may be transferred from the receptacle 16 by an auger-type conveyor 18 which may be suitably driven in the conventional manner by a drive motor 19. The conveyor 18 includes at its distal end auger blade means 20 carried on an axial shaft 21 of the conveyor 18 within a tubular housing 22. The housing is partially closed at its outer end by a transverse wall 23 defining an upper inlet portion, opening 24, through which the ice bodies 17 delivered by the auger 20 to a transfer space 25 defined by an outer housing 26 coaxially receiving housing 22 and further defining an outlet portion, opening 27. When the door 15 is in the closed position of FIG. 1, opening 27 is disposed above the upper end of a delivery chute 28 associated with the delivery area 12, as shown in FIG. 3, and, thus, chute 28 is in position to receive ice from the outlet opening 27.

Figure 4:
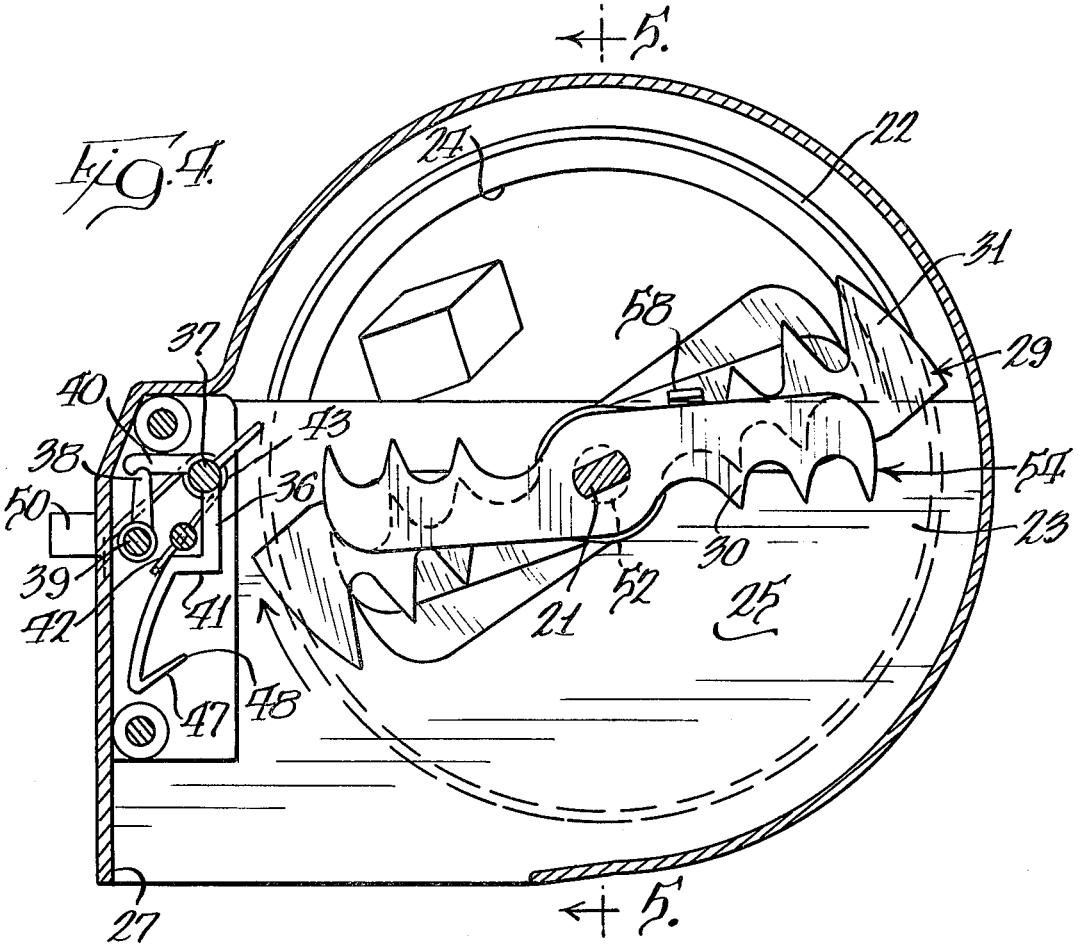
FIG. 4 is a further enlarged fragmentary transverse section illustrating the arrangement of the ice delivering means for delivering ice bodies to the outlet portion.
Figure 5:
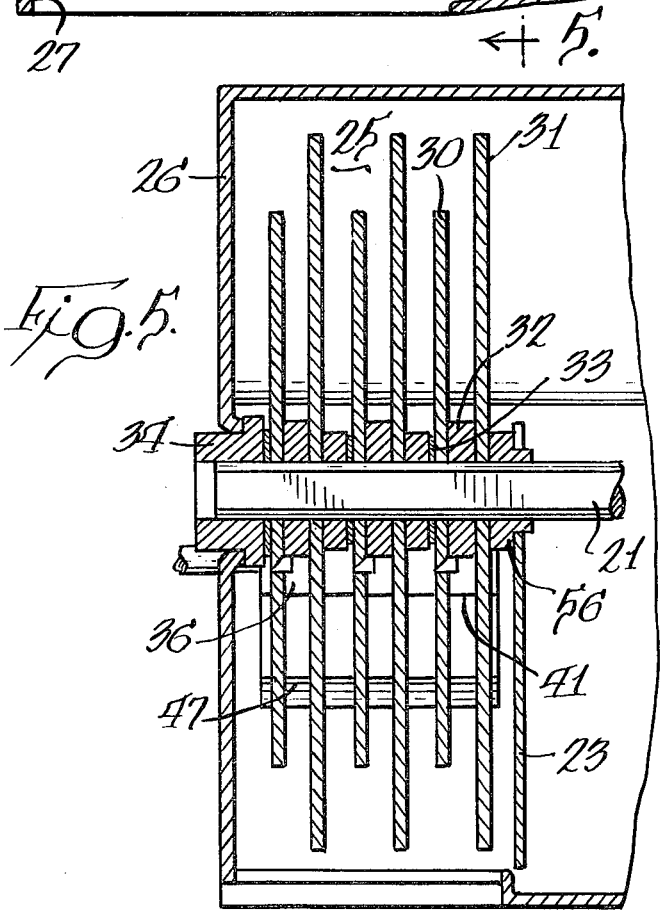
FIG. 5 is a vertical section taken substantially along the line 5—5 of FIG. 4.

Referring to FIGS. 4 and 5, ice bodies may be passed intact from the inlet opening 24 to the outlet opening 27 by cooperating first crusher arm means generally designated 54 and second crusher arm means generally designated 29 mounted for rotation with shaft 21. The crusher arm means comprise interleaved first crusher arms 30 defining crusher arm means 54 and second crusher arms 31 defining crusher arm means 29. As seen in FIG. 4, the crusher arms 30 are keyed to the shaft 21 for positive direct drive by the shaft whereas the crusher arms 31 receive the shaft 21 in circular holes 52 thereof. More specifically, the second crusher arms are friction-coupled to the shaft 21 as a result of being mounted coaxially with a plurality of washers 32 which are coaxially mounted on the shaft 21. The second crusher arms are frictionally retained in association with the washers 32 by friction washers 33 interposed therebetween. Thus, the first crusher arms 30 are always driven directly with the shaft 21 whereas the second crusher arms 31 are driven with the shaft as long as their rotation in space 25 is unimpeded. It is desirable, though not essential, that the first and second crusher arms be substantially aligned during periods of rotation, as illustrated in FIG. 4. Suitable alignment means, such as finger 58, associated with the washers 32 are provided to effect such alignment.

As shown in FIG. 4, as the shaft 21 rotates in a clockwise direction to carry the arms 30 and 31 together therewith, ice bodies entering space 25 through the inlet opening 24 are urged by the arms downwardly to the outlet opening 27 for dispensing of the ice bodies substantially intact to the delivery or dispensing area 12 through the chute 28.

As further shown with reference to FIGS. 3 and 5, shaft 21 may be maintained coaxially within the housing 26 by forward bearing 34 and a rear bearing 35 carried on the rear wall of receptacle 16, so as to coaxially journal the rotating shaft 21. Transverse dividing wall 23 is supported by shaft 21 by means of washer 56, the wall 23 being otherwise free or floating.

Figure 6:
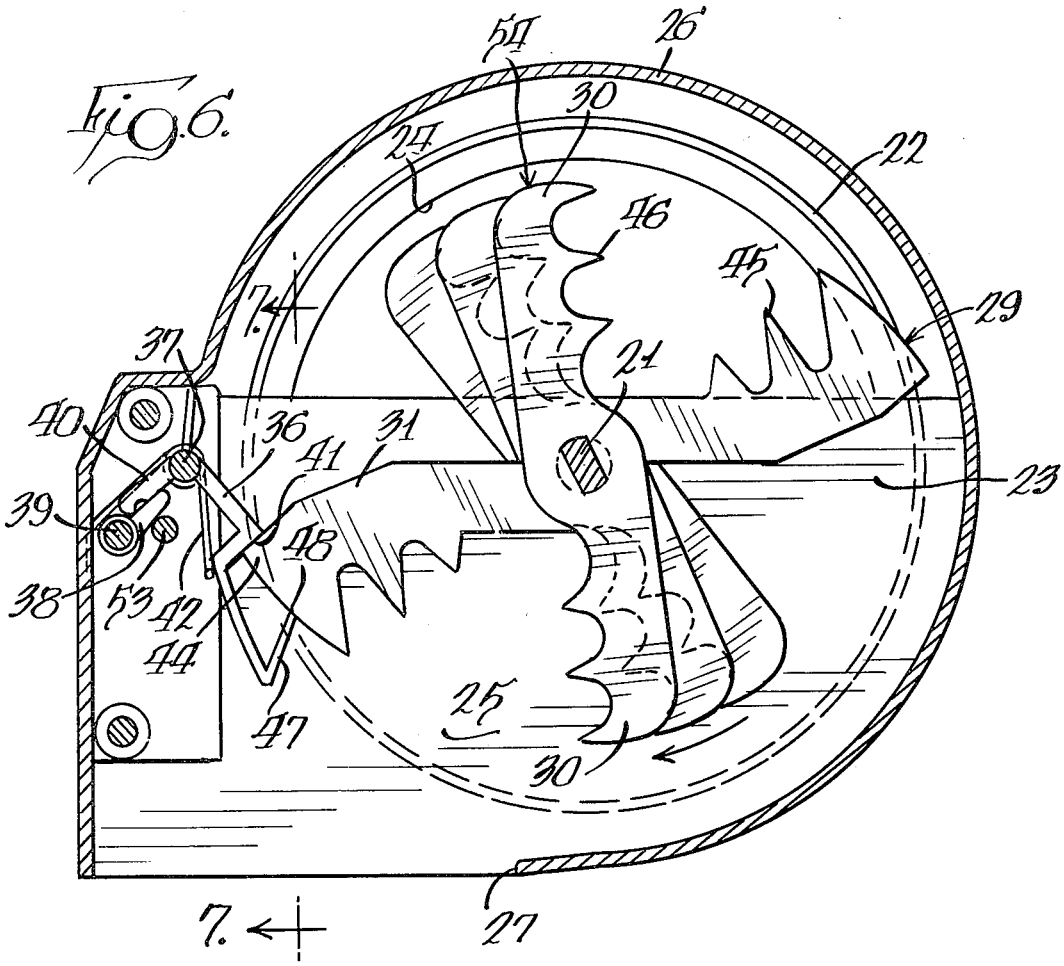
FIG. 6 is a transverse section similar to that of FIG. 4 but illustrating the arrangement of the ice delivering means to provide the ice in the form of crushed ice to the outlet portion.
Figure 7:
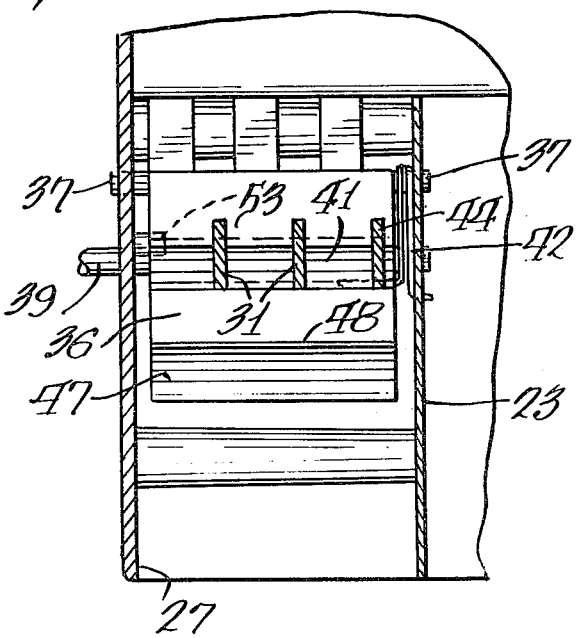
FIG. 7 is a fragmentary vertical section taken substantially along the line 7—7 of FIG. 6.

Referring now more specifically to the arrangement of FIGS. 6 and 7, when it is desired to deliver crushed ice from the apparatus 10 in lieu of the intact ice bodies 17, rotation of the friction-coupled arms 31 is stopped while permitting the arms 30 to continue to rotate directly with the shaft 21. The stopping of rotation of arms 31 is effected by a suitable stop 36 which is movably carried by the housing 26 and which, as shown in FIG. 6 more specifically, is pivotally mounted to the housing by a suitable pivot 37. The disposition of stop 36 is controlled by a suitable selector lever 38 defining means for selectively positioning the stop 36 in the path of movement of the arms 31 or out of the path of movement thereof as desired. As shown in FIG. 6, the lever 38 may be movably carried on the housing 26 and more specifically, may be pivotally mounted thereto by a pivot 39. Lever 38 engages an arm 40 on the stop 36 so that when the lever 38 is swung in a counterclockwise direction about the axis of pivot 39, as seen in FIG. 6, the lever urges the arm 40 in a clockwise direction about the axis of pivot 37, thereby retracting the stop 36 to the retracted position of FIG. 4.

In the retracted position, a stop shoulder 41 of the stop is moved out of the path of movement of the arms 31 so as to permit the arms to rotate freely through the space 25 without hindrance by the stop. The stop is maintained in the retracted position against the biasing action of a torsion spring 42 having a midportion 43 wrapped about the pivot 37. As shown in FIG. 6, the spring 42 urges the stop 36 in a counterclockwise direction to a limit determined by the engagement of the selector lever 38 with a pin 53 carried on the housing adjacent the pivot pins 39 and 37, as shown in FIG. 6. In the retracted position, lever 38 is arranged to extend substantially perpendicularly to arm 40 so as to effectively positively lock the stop 36 against the action of the spring 42.

When the lever is swung in a clockwise direction from the perpendicular relationship, spring 42 may then bias the stop 36 in a counterclockwise direction until the arm 40 brings the lever 38 into engagement with pin 53, thereby limiting the clockwise rotation of the lever 38 and the counterclockwise rotation of the stop 36 to the position of FIG. 6 wherein the stop shoulder 41 is in the path of movement of the distal corner portions 44 of the second crusher arms 31. Thus, when the rotation of the shaft 21 brings the crusher arms 31 into abutment with the stop 36, further rotation of the crusher arms 31 is prevented while the continued rotation of crusher arms 30 is permitted.

As seen in FIG. 6, while the crusher arms 30 and 31 have generally similar configurations, the crusher arms 31 have a greater radial extent so as to engage the stop shoulder 41 when it is disposed in the crusher arm engaging position while the crusher arms 30 continue to have clearance to rotate. Shaft 21 is thus permitted to continue to rotate to provide relative movement between the two sets of crusher arms. As a result of the movement of crusher arms 30, the ice bodies delivered through inlet opening 24 are carried clockwise into engagement with the teeth 45 of the second crusher arms 31 which, in their stationary disposition, effectively act as anvils. The ice bodies are crushed between the teeth 45 of the crusher arms 31 and complementary teeth 46 of the rotating first crusher arms 30.

As seen in FIG. 6, the crushing action occurs primarily in the upper right portion of housing 26. Once the ice bodies are crushed between the teeth 45 and 46, the resulting crushed ice is delivered downwardly through the outlet opening 27 and chute 28 to the delivery area 12.

Referring more specifically to FIG. 6, it should be noted that the crusher arm portions 44 act directly through the stop 36 against the pivot 37 to provide a positive locked retention of the crusher arms against the substantial forces developed by the moving crusher arms 30 in crushing the ice bodies between the crusher arm teeth 45 and 46. As further seen in FIG. 6, the stop 36 includes a distal turned portion 47 and end shoulder 48 which cooperate with shoulder 41 in effectively preventing rotation of the held crusher arms 31 in either direction of rotation about the axis of the shaft 21 so as to provide a positive crushing action in the apparatus.

Figure 8:
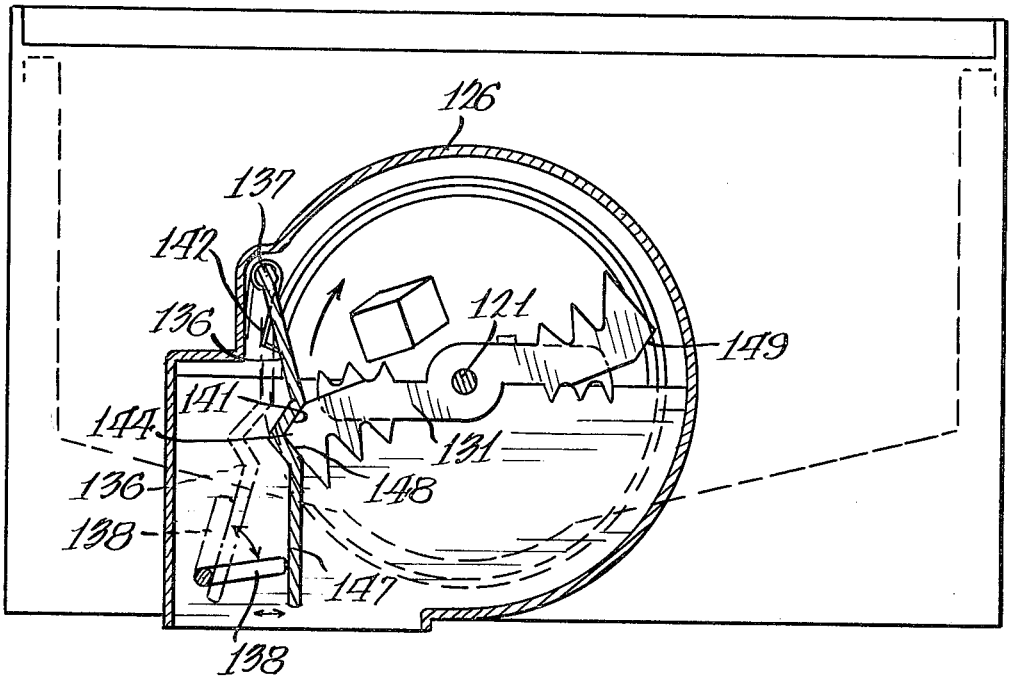
FIG. 8 is a fragmentary vertical section illustrating another form of the selector means for controlling the movement of the crusher arm means of the apparatus.

Referring now to FIG. 8, a modified form of the invention is illustrated. As shown therein, the stop 136 is pivotally mounted to the housing 126 by a pivot pin 137 closely adjacent the sidewall of the housing. The stop includes an angular midportion defining, in turn, the stop shoulders 141 and 148 for capturing the distal end 144 of the second crusher arms 131 in the stationary disposition. A suitable spring 142 may be provided mounted to the housing 126 for biasing the stop in a counterclockwise direction, as seen in FIG. 8, so as to maintain the stop in the position shown in solid lines. The selector control lever 138 is arranged to engage the distal end 147 of the stop 136 in positioning it in the arm holding, or ice crushing, position shown in solid lines in FIG. 8. In this position, the lever 138 is substantially perpendicular to end portion 147 and thus prevents the stop 136 from being rotated clockwise by forces transmitted from the second crusher arms 131 during ice crushing.

The bias provided by spring 142 is selected such that, unless clockwise rotation of the stop 136 is prevented by lever 138, the second crusher arms 131 will move the stop clockwise and pass thereby whenever the shaft 121 is rotatively driven.

As further seen in FIG. 8, the distal portion of the arms 131 may be provided with a double surface 149 adapted to provide accurate conformity of the arm distal portion 144 with the stop shoulders 141 and 148.

Control of the selector lever 38 may be effected, as will be obvious to those skilled in the art, by any suitable means, such as solenoid 50, illustrated in FIG. 4. Alternatively, pivoting of the control lever 38 on pivot 39 may be effected by suitable manual means within the scope of the invention, as desired. Further, as will be obvious to those skilled in the art, the friction coupling of the crusher arms 31 to the drive shaft 21 may be effected by any suitable clutch means, the friction clutch means of the illustrated embodiment being only exemplary. Still further, as will be obvious to those skilled in the art, the number of interleaved crusher arms 30 and 31 may be varied as desired.

The location of the stop and control lever means within the housing permits the structure to be protected by the housing and avoids the need for any large opening in the housing through which ice chips may otherwise undesirably pass.

The use of the crusher arms to effect the transfer of the ice bodies from the inlet opening to the outlet opening rather than relying on gravity to effect a direct fall of the ice bodies from the inlet to the outlet eliminates the need for accurate clearances and alignment in the location of the crusher arms relative to the inlet and outlet openings.

Further, the use of the distal end portions 47 and 147 in the illustrated two embodiments at the downstream side of the outlet opening 27 permits these portions to function as guides in directing the ice bodies and crushed ice to the outlet opening, thus further improving the operation of the apparatus.

As both sets of crusher arms rotate when the stop is in the retracted position, the ice bodies are effectively transferred thereby substantially intact so as to avoid breaking or crushing of the ice bodies. This avoids a problem in the prior art wherein some crushing action has often occurred notwithstanding the arrangements of the structures in the complete ice body delivering mode.

As discussed above, the ice delivering apparatus may utilize the same drive motor as utilized for operating the conveyor 18, thereby minimizing the cost of the apparatus.

It has further been found that by utilization of the improved ice delivering apparatus, the auger portion 20 of the conveyor 18 may be axially shortened so as to permit the housing 26 to have an axial extent no greater than in the prior art structures utilizing an auger alone for the delivery means. Thus, the ice making, storing and delivering means may be incorporated substantially within the same space as in the prior art structures omitting the selective ice delivering means.

The use of the limited area inlet opening 24 assures that the ice bodies will be delivered to the space 25 suitably to be picked up by the crusher arms for delivery to the outlet as discussed above.

The foregoing disclosure of specific embodiments is illustrative of the broad inventive concepts comprehended by the invention.

Having described the invention, the embodiments of the invention in which an exclusive property or privilege is claimed are defined as follows:

1. Apparatus for delivering ice from an ice body supply to an ice delivery area selectively in ice body form or as crushed ice, comprising:

housing means defining an inlet portion for receiving ice bodies from said supply and an outlet portion communicating with said delivery area;

a rotatable shaft disposed within said housing;

first crusher arm means fixed to said shaft for rotation coaxially therewith;

second crusher arm means coupled to said shaft for releasable rotation coaxially therewith; and selector means movably carried in said housing and selectively positionable in a first position out of the path of rotation of said second crusher arm means allowing unhindered rotation of said second crusher arm means with said shaft thereby permitting said first and second crusher arm means to deliver the ice bodies substantially intact to said outlet portion, and in a second position in the path of rotation of said second crusher arm means for preventing rotation of said second crusher arm means to cause the ice bodies to be crushed between said first and second crusher arm means as a result of rotation of said first crusher arm means with said shaft while said second crusher arm means is being maintained against rotation therewith for delivery of the ice to said outlet portion in the form of crushed ice.

2. The ice delivering apparatus of claim 1 wherein said first crusher arm means comprise a plurality of first crusher arms and said second crusher arm means comprise a plurality of second crusher arms interleaved between said plurality of first crusher arms.

3. The ice delivering apparatus of claim 1 wherein said second crusher arm means is coupled to said shaft by a yieldable clutch and arranged to rotate in substantial alignment with said first crusher arm means.

4. The ice delivering apparatus of claim 3 wherein said clutch comprises a friction clutch.

5. The ice delivering apparatus of claim 1 wherein said second crusher arm means is coupled to said shaft by a yieldable clutch including detent means for causing said second crusher arm means to be substantially aligned with said first crusher arm means when said selector means is arranged in said first position.

6. The ice delivering apparatus of claim 1 wherein said first and second crusher arm means comprise interleaved blades.

7. The ice delivering apparatus of claim 1 wherein said selector means comprises a stop movably carried by said housing and means for selectively positioning said stop in the path of movement of said second crusher arm means.

8. The ice delivering apparatus of claim 1 wherein said selector means comprises a stop movably carried by said housing and solenoid means for selectively positioning said stop in the path of movement of said second crusher arm means.

9. The ice delivering apparatus of claim 1 wherein said selector means comprises means for holding the second crusher arm means against rotation in either direction about the axis of said shaft.

10. Apparatus for delivering ice from an ice body supply to an ice delivery area selectively in ice body form or as crushed ice, comprising:

housing means defining an inlet portion for receiving ice bodies from said supply and an outlet portion communicating with said delivery area;

a rotatable shaft disposed within said housing;

a first elongated crusher arm extending radially from and being fixed to said shaft for rotation coaxially therewith;

a second elongated crusher arm extending radially from and being frictionally coupled to said shaft for releasable rotation coaxially therewith;

stop means movably carried in said housing; and lever means cooperating with said stop means and selectively positionable in a first position which permits said stop to move out of the path of rotation of said second crusher arm thereby permitting said first and second crusher arms to deliver the ice bodies substantially intact to said outlet portion, and in a second position wherein said stop means is maintained in the path of rotation of said second crusher arm for preventing rotation of said second crusher arm to cause the ice bodies to be crushed between said first and second crusher arms as a result of the rotation of said first crusher arm with said shaft while said second crusher arm is maintained against rotation therewith for delivery of the ice to said outlet portion in the form of crushed ice.

11. The ice delivering apparatus of claim 10 wherein said arms are provided with teeth for engaging the ice bodies as a result of rotation thereof.

12. The ice delivering apparatus of claim 10 wherein each of said arms comprises opposed, radially extending blades on opposite sides of said shaft.

13. The ice delivering apparatus of claim 10 wherein said stop means is movably mounted to said housing.

14. The ice delivering apparatus of claim 10 wherein said lever means is movably mounted to said housing.

15. The ice delivering apparatus of claim 10 wherein said stop defines cooperating shoulder means engaging said second crusher arm to prevent rotation of said second crusher arm in either direction about the axis of said shaft as an incident of said lever means being disposed in said second position.

16. The ice delivering apparatus of claim 10 wherein said stop includes a guide portion disposed adjacent said outlet portion for guiding ice from said crusher arm means to said outlet portion.

17. The ice delivering apparatus of claim 10 wherein said crusher arms define means for carrying the ice bodies from the inlet portion to the outlet portion.

18. In a refrigeration apparatus having means for selectively delivering ice in either crushed or uncrushed form from an ice supply to an ice delivery area, said ice delivery means including a rotatable shaft and first crusher arm means fixed to said shaft for rotation therewith, the improvement comprising:

second crusher arm means disposed about said shaft coaxially with said first crusher arm means;

releasable coupling means disposed about said shaft for releasably coupling said second crusher arm means to said shaft for rotation therewith; and, selector means disposed in proximity to said second crusher arm means and selectively movable between a first position which permits concurrent rotation of said first and second crusher arm means whereby uncrushed ice bodies are carried thereby to said ice delivery area and a second position wherein said selector means engages said second crusher arm means to prevent rotation thereof, thereby causing ice bodies to be crushed between said first and second crusher arm means as incident of rotation of said first crusher arm means.

19. In a refrigeration apparatus having an ice storage receptacle and an ice delivery area spaced from said receptacle, an ice delivery apparatus for selectively delivering ice from said receptacle to said delivery area in either uncrushed or crushed form, comprising:

a housing positioned between said receptacle and said delivery area, having an inlet for receiving ice from said receptacle and an outlet in communication with said delivery area;

a shaft mounted for rotation within said housing;

drive means connected to said shaft for selectively causing rotation thereof;

a first set of crusher arms fixed to said shaft for rotation therewith, each of said arms comprising a pair of opposed, radially extending blades having teeth extending in the direction of rotation, said crusher arms being disposed within said housing so as to intercept ice bodies entering said housing from said inlet and carry the ice bodies to said outlet;

a second set of crusher arms disposed about said shaft interleaved and coaxial with said first crusher arms, each of said second crusher arms comprising a pair of opposed, radially extending blades having teeth extending in the opposite direction of rotation;

frictional coupling means disposed about said shaft for releasably coupling said second crusher arms to said shaft for rotation therewith, said coupling means including alignment means for causing said second crusher arms to rotate in substantial alignment with said first crusher arms; and, a selectively movable stop disposed in proximity to said second crusher arms and movable between a first position in which said second crusher arms are permitted to rotate to thereby permit delivery of uncrushed ice bodies to said delivery area and a second position in which said stop contacts said second crusher arms to prevent rotation thereof to thereby cause ice bodies to be crushed between said first and second crusher arms prior to delivery to said delivery area.

* * * * *